US006619880B1

(12) United States Patent
Jensen

(10) Patent No.: US 6,619,880 B1
(45) Date of Patent: Sep. 16, 2003

(54) PAVEMENT MARKINGS WETTING DEVICE AND METHOD

(76) Inventor: Hans F. Jensen, 216 Outrigger Landing, Denton, NC (US) 27239

( * ) Notice: Subject to any disclaimer, the term of this patent is extended or adjusted under 35 U.S.C. 154(b) by 0 days.

(21) Appl. No.: 10/178,866

(22) Filed: Jun. 24, 2002

(51) Int. Cl.[7] ..... E01C 23/16

(52) U.S. Cl. ..... 404/94; 404/72; 141/105

(58) Field of Search ..... 404/72, 101, 102, 404/93, 94; 141/100, 105, 286

(56) References Cited

U.S. PATENT DOCUMENTS 4,376,007 A * 3/1983 Eigenmann ..... 156/497
5,169,262 A * 12/1992 Wilson et al. ..... 404/94
6,240,983 B1 * 6/2001 Beldham et al. ..... 141/100

* cited by examiner

*Primary Examiner*—Thomas B. Will
*Assistant Examiner*—Tara L. Mayo

(57) ABSTRACT

A pavement marking wetting device provides consistent, even wetting to pavement markings for use in taking retroreflectivity measurements. The wetting device includes a nozzle which is connected to the tank of a water truck for fast, efficient wetting. The nozzle includes an air gap which creates a balancing of air pressure, thereby insuring consistent, even dispersion.

17 Claims, 3 Drawing Sheets

PAVEMENT MARKINGS WETTING DEVICE AND METHOD

FIELD OF THE INVENTION

The invention herein pertains to measurement of the retroreflectivity of pavement markings and particularly pertains to a device for attachment to a water truck for consistent wetting of linear pavement markings.

DESCRIPTION OF THE PRIOR ART AND OBJECTIVES OF THE INVENTION

With the increased use of roads, highways and the like in recent years pavement markings have become increasingly important in preventing accidents and saving lives. Markings are made of various materials and have varying degrees of retroreflectivity which is of great importance in dark and adverse weather conditions. Vehicles equipped with retroreflectivity measuring devices are used to collect retroreflective data from the markings to evaluate their performance. Certain tests require wetting pavement markings before retroreflectivity readings can be taken. This process can be done using a handheld retroreflectometer and a bucket of water to flood the pavement marking. The allotted time must pass before placing the handheld retroreflectometer on the pavement marking to take a retroreflectivity reading. Once the reading is taken, a distance must be covered on foot before repeating this process. This process is time consuming and increases the chances of undue personnel risk for collecting data over long distances.

Thus, there exists a need for a uniform method of applying at highway speeds, a water layer. In recognition and potential safety hazards prior art devices and methods, the present invention was conceived and one of its objectives is to provide a device for evenly applying water to pavement markings for retroreflectivity measurement and data collection purposes, all done at highway speeds.

It is also an objective of the present invention to use a water distribution nozzle in conjunction with a mobile retroreflectometer to increase data collection compared to collection of data with a handheld retroreflectometer.

It is a further objective of the present invention to provide a method of water flow and exact distribution along the pavement markings without significant water contacting the roadway outside the designed area.

It is still another objective of the present invention to provide a water nozzle which will allow even dispersion of water from a moving vehicle as it travels along an extended length of pavement markings.

It is yet another objective of the present invention to provide a water dispersion nozzle which can be easily connected to a conventional water truck for use in retroreflectivity measurements.

It is yet another objective of the present invention to provide a method which will ensure a consistent wetting of pavement markings over miles of highway at highway speeds.

It is yet another objective of the present invention to provide a nozzle for wetting pavement markings which is easy to use and does not require extensive training.

Various other objectives and advantages of the present invention will become apparent to those skilled in the art as a more detailed description is set forth below.

SUMMARY OF THE INVENTION

The aforesaid and other objectives are realized by providing a wetting device which can be attached to a standard water truck in a quick and easy manner. The device includes a nozzle having a water conduit which can be attached to a supply pipe and outlet valve for gravity feeding water from the tank of a water truck. The nozzle includes a manifold which receives water from the water conduit and distributes it through a slot therein. Water passing through the slot falls downwardly through a first chamber in the nozzle housing and is dispensed onto the marking below as the truck travels along the highway. Air passing into the nozzle from below is directed across the lower end of a divider and into the second chamber where it exits through an air gap in the back of the nozzle housing. This balancing of air pressure thus asserts in an even dispersion of water onto the markings.

Following the water tank truck is a retroreflectivity measurement vehicle at a specified number of seconds behind. Both vehicles can operate effectively traveling at moderate highway speeds and can thus cover great lengths of highway in a relatively short time to achieve uniform retroreflectivity data collection.

DETAILED DESCRIPTION OF THE PREFERRED EMBODIMENT AND OPERATION OF THE INVENTION

Figure 1:
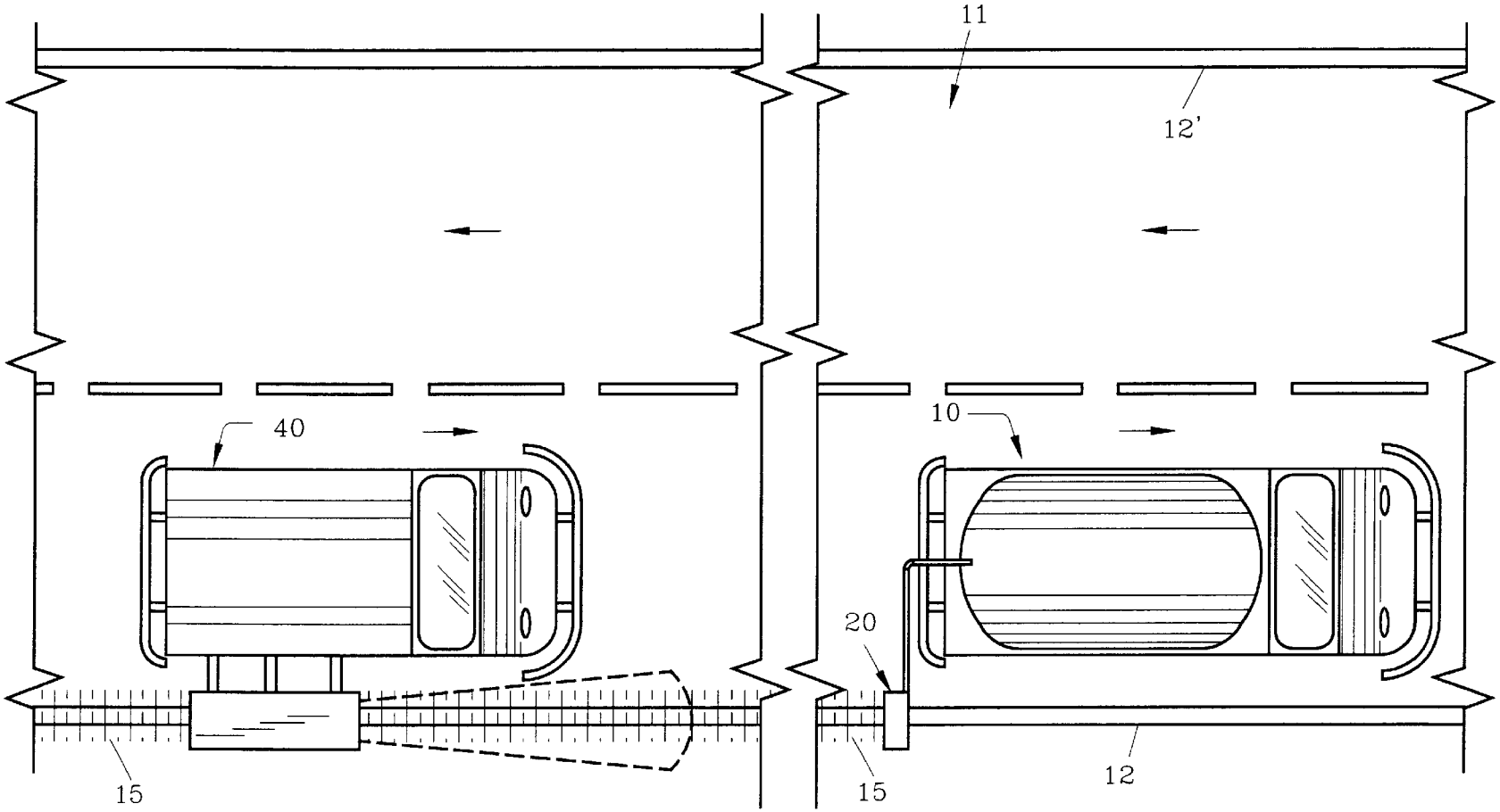
FIG. 1 illustrates a schematic top view of water application and retroreflecting measurements along a highway edge line marking.

For a better understanding of the invention and its operation, turning now to the drawings, FIG. 1 illustrates water tank truck 10 traveling along two lane highway 11 in an easternly direction (left to right in FIG. 1). Highway 11 includes edge line markings 12, 12' which are conventional retroreflective edge markings to assist drivers in maintaining their vehicles on highway 11, particularly at night and during rainy and other adverse weather conditions when visibility is poor. Markings 12 are approximately four inches (10.16 cm) in width and have a height of approximately one-eighth inch (0.33 cm) and are formed from a retroreflective composition. As water tank truck 10 moves along highway 11, preferred nozzle 20 disperses water 15 to thoroughly cover marking 12 while traveling at moderate highway speeds. Water tank truck 10 is followed by conventional retroreflectivity measurement vehicle 40, traveling at the same speed as the water tank truck 10 with a specified lag time. Vehicle 40 measures the retroreflectivity of markings 12 for use in determining the effectiveness of markings 12 under wet conditions for comparison purposes.

Figure 2:
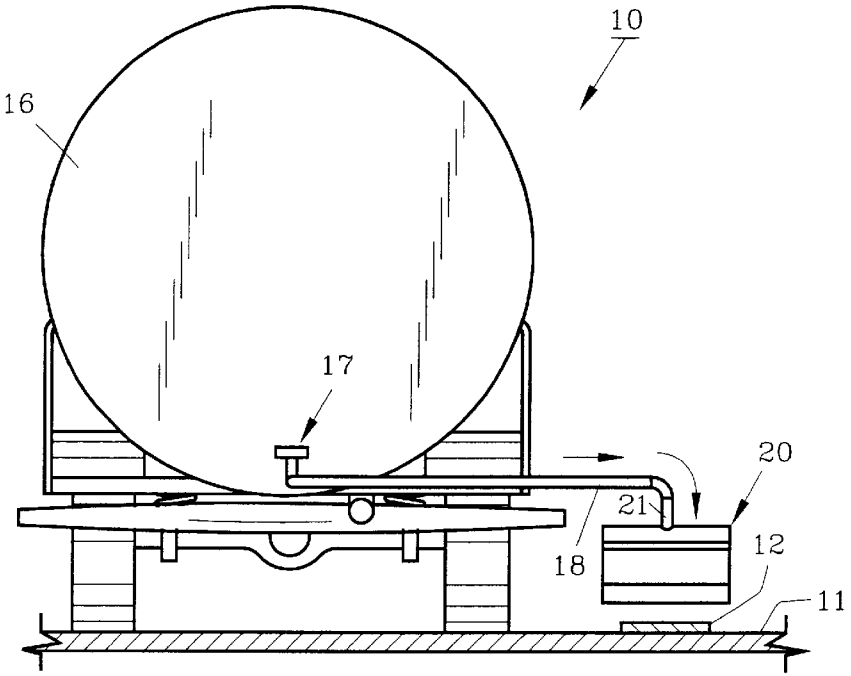
FIG. 2 shows the rear view of the water tank truck as seen in FIG. 1.

As shown in FIG. 2, water tank truck 10 includes water tank 16 for containing water and outlet valve 17 for releasing water into nozzle supply pipe 18 for preferred nozzle 20. Thus, by opening adjustable valve 17 a desired amount of water from tank 16 drains by gravity through supply pipe 18 and into nozzle 20 for dispersing purposes. The flow rate through nozzle 20 can thus be regulated by valve 17.

Figure 3:
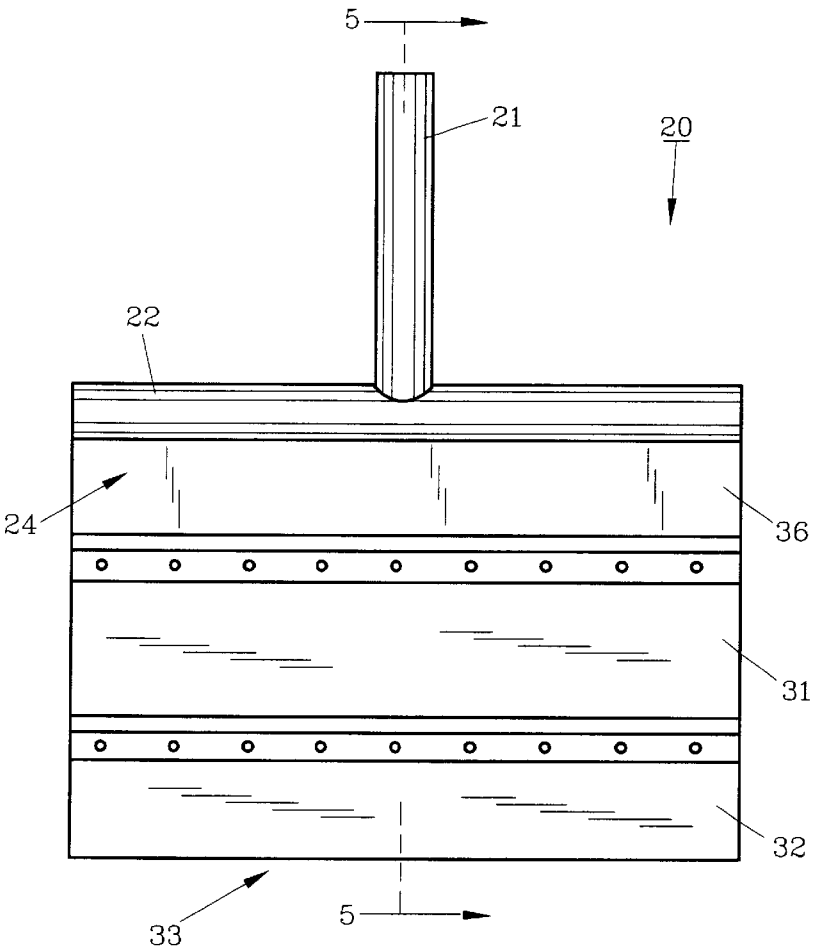
FIG. 3 demonstrates an enlarged front view of the water nozzle herein.

In FIG. 3 a front elevational view of nozzle 20 is shown with water conduit 21 joined to manifold 22. Water conduit 21 is in turn joined to supply pipe 18 as seen in FIG. 2. Conduit 21 consists of preferably a conventional aluminum pipe having a two inch (5.08 cm) od. Manifold 22 likewise consists of a two inch (5.08 cm) od aluminum pipe having a length of approximately twenty-four inches (60.96 cm) and is connected to conduit 21 by conventional means such as heliarc welding.

Figure 5:
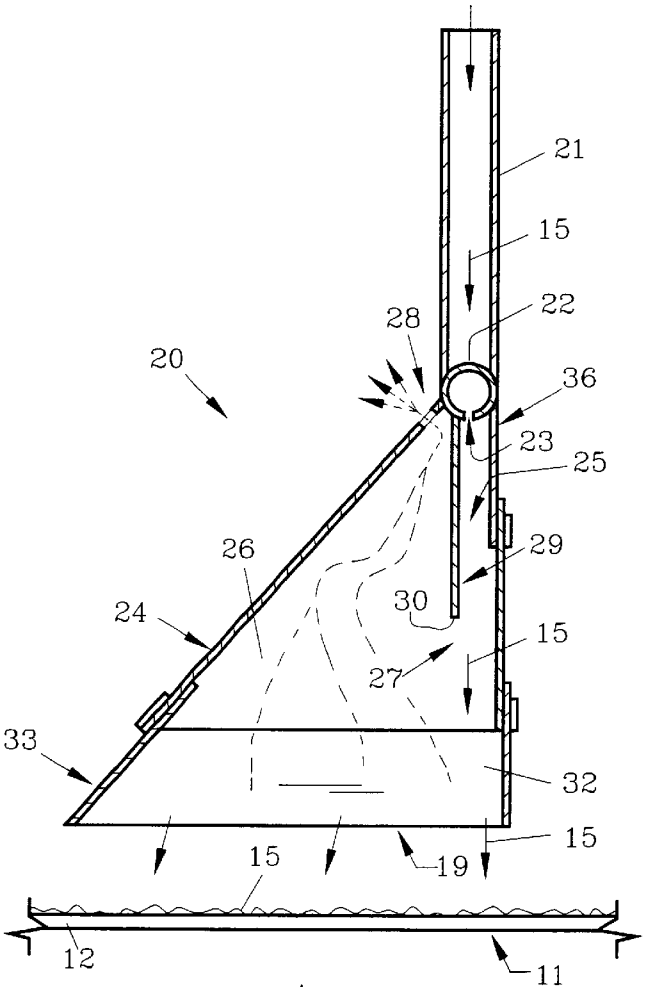
FIG. 5 depicts a cross-sectional view of the nozzle along lines 5—5 of FIG. 3.

In FIG. 5, triangularly shaped nozzle 20 is seen with manifold 22 shown in cross section with a 0.500 inch (1.27 cm) wide slot 23 which extends the entire width of manifold 22 to allow water 15 to flow therethrough into first chamber 25 of nozzle 20. Water passing through first chamber 25 exits along the bottom opening 19 of housing 24.

Figure 4:
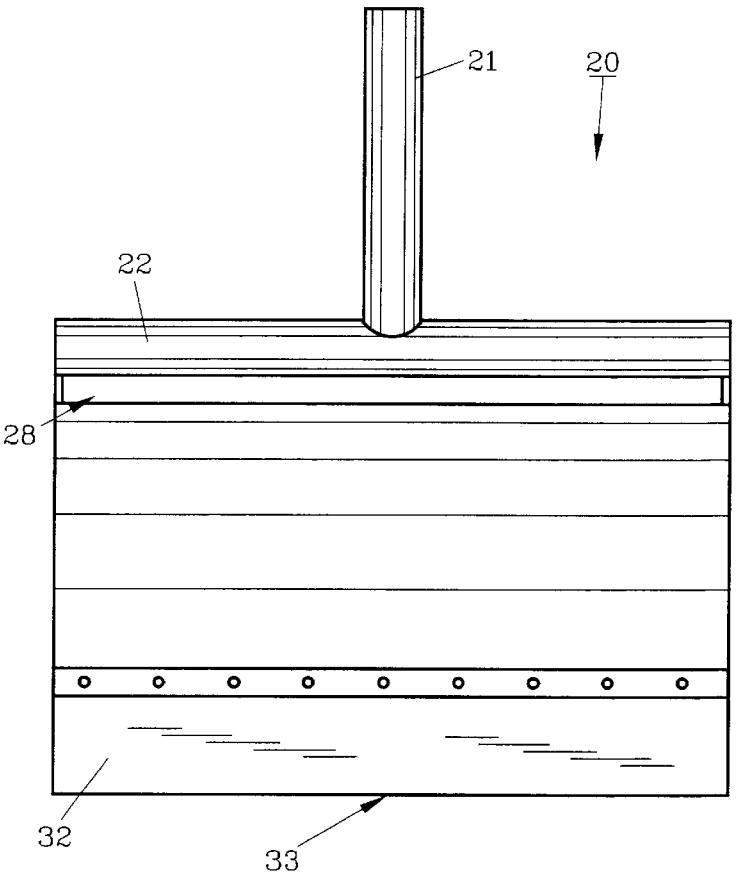
FIG. 4 pictures a rear view of the nozzle seen in FIG. 3.

To improve the evenness and dispersion of water 15 along marking 12, air slot 28 is positioned in air chamber 26 of housing 24 as seen in FIGS. 4 and 5. Air gap 28 extends approximately the width of housing 24 and allows air within second chamber 26 to exit therefrom as seen in dashed line arrows in FIG. 5. Balancing the air pressure between first chamber 25 and second chamber 26 improves the dispersion of water to a defined area. Divider 29 which is attached to manifold 22 also extends the entire width of housing 24 and separates first chamber 25 from second chamber 26 while lower edge 30 of divider 29 defines passageway 27 therebetween. Passageway 27 allows fluid flow between first chamber 25 and second chamber 26. Divider 29 extends downwardly from manifold 22 approximately seven inches (17.78 cm).

To prevent harmful impact to housing 24 as when traveling over uneven roads or the like, the front of housing 24 is formed from upper aluminum plate 36 approximately one-quarter inch thick (0.635 cm) and is attached to manifold 22 and extends downwardly therefrom approximately four and one-half inches (11.43 cm). Aluminum plate 36 as seen in FIG. 3 is affixed by screws or rivets to rubber sheeting 31 therealong which is a conventional one-quarter inch (0.635 cm) flexible rubber sheet. To the bottom edge of sheet 31 a thin, one-eight inch (0.32 cm) flexible rubber flange 32 is attached, also by rivets, screws or other conventional fasteners. Flange 32 is likewise fastened to the back and sides of housing 24 as shown in FIGS. 4 and 5 to form flexible skirt 33 surrounding bottom nozzle opening 19 to soften impacts that may be encountered on rough, uneven roads. Thus, should an uneven section of highway be encountered, skirt 33 which is approximately three and one-half inches (8.89 cm) in height will bend and flex to prevent rigid housing 24 from experiencing damage.

The preferred method of wetting pavement markings is illustrated in FIGS. 1 and 2 whereby water from tank 16 of water tank truck 10 is gravity delivered through outlet valve 17, through supply pipe 18, through water conduit 21 and into manifold 22 of nozzle 20 while water tank truck 10 moves at moderate highway speeds along highway 11 with nozzle 20 positioned about two inches (5.08 cm) thereabove. Water 15 is thus directed from tank 16 to first chamber 25 of nozzle 20 where it exits housing 24 through bottom opening 19 onto markings 12. Air flows, for example from first chamber 25 to second chamber 26 and exits housing 24 through air gap 28 balancing the air pressure between first chamber 25 and second chamber 26 thereby evenly dispersing water 15 along markings 12. Mobile retroreflectivity measurement vehicle 40 as shown in FIG. 1 follows water truck 10 and collects retroreflectivity data as it lags water truck 10 a specified number of seconds. The data collected can thereafter be analyzed and the consistency, retroreflectivity and other characteristics of markings 12 can be determined and compared to other markings types and compositions.

The illustrations and examples provided herein are for explanatory purposes and are not intended to limit the scope of the appended claims.

I claim:

1. A nozzle for attachment to a supply pipe of a vehicle for use in spraying highway markers as the vehicle moves along the highway comprising: a housing, a divider, said divider positioned within said housing to separate said housing into a first and a second chamber, said housing defining an open bottom to allow liquid from said first chamber to exit directly therethrough, said first chamber for dispensing liquid onto the highway markers and said second chamber to allow air flow from said housing, a water conduit, said water conduit for connection to the supply pipe and in fluid communication with said first chamber, whereby water from said water conduit can pass through said first chamber and exit said housing onto a highway marker.

2. The nozzle of claim 1 wherein said housing defines an air gap, said air gap in communication with said second chamber.

3. The nozzle of claim 1 wherein said housing comprises a flexible skirt, said skirt attached along the bottom of said housing.

4. The nozzle of claim 1 further comprising a manifold, said manifold attached to said water conduit for receiving water therefrom.

5. The nozzle of claim 4 wherein said manifold is positioned within said first chamber.

6. The nozzle of claim 4 wherein said manifold defines a slot to allow water within said manifold to exit into said first chamber.

7. The nozzle of claim 1 wherein said divider defines an air passageway, said passageway positioned between said first and said second chambers.

8. The nozzle of claim 1 wherein said housing has a triangular shape in cross section.

9. A device for wetting pavement markings attached to a vehicle comprising: a water tank, said tank affixed to said vehicle, a supply pipe, a nozzle, said supply pipe affixed to said tank and said nozzle, said nozzle comprising a housing, said housing defining an opening along its bottom, a divider, said divider positioned within said housing, said divider separating said housing into a first chamber and a second chamber whereby water from said tank is delivered to said first chamber for distribution directly through said housing bottom opening onto pavement markings below.

10. The device of claim 9 wherein said housing defines an air gap, said air gap in communication with said second chamber.

11. The device of claim 9 further comprising a flexible skirt, said skirt affixed to said housing along the bottom thereof.

12. The device of claim 9 further comprising a water conduit, said water conduit in fluid communication with said first chamber, said water conduit attached to said supply pipe.

13. A method of wetting pavement markings using a nozzle attached to a vehicle water tank, said nozzle having a housing with an open bottom and separated into first and second chambers, said first chamber in direct fluid communication with the open bottom comprising the steps of:

a) directing water from the tank to the first chamber;

b) allowing air flow through the second chamber to improve the water flow; and c) dispensing water from the first chamber directly through the open bottom onto a pavement marking below.

14. The method of claim 13 wherein directing the water comprises the step of directing the water using gravity.

15. The method of claim 13 wherein allowing air flow through the second chamber comprises the step of allowing air to flow over a divider positioned between the first and second chambers.

16. The method of claim 13 further comprising the step of driving the vehicle along the highway while directing water from the tank to the first nozzle chamber.

17. The method of claim 13 further comprising the step of measuring the retroreflectivity of the wetted marking.

* * * * *